US008304374B2

(12) United States Patent
Brown et al.

(10) Patent No.: US 8,304,374 B2
(45) Date of Patent: Nov. 6, 2012

(54) ANTIWEAR AGENT AND LUBRICATING COMPOSITION THEREOF

(75) Inventors: Jason R. Brown, Katy, TX (US); Patrick E. Mosier, Bay Village, OH (US); Paul E. Adams, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 235 days.

(21) Appl. No.: 12/445,491

(22) PCT Filed: Oct. 22, 2007

(86) PCT No.: PCT/US2007/082057

§ 371 (c)(1),
(2), (4) Date: Apr. 14, 2009

(87) PCT Pub. No.: WO2008/070307

PCT Pub. Date: Jun. 12, 2008

(65) Prior Publication Data

US 2010/0048437 A1 Feb. 25, 2010

Related U.S. Application Data

(60) Provisional application No. 60/862,534, filed on Oct. 23, 2006.

(51) Int. Cl.
*C10M 129/72* (2006.01)
*C10M 141/10* (2006.01)

(52) U.S. Cl. ..... 508/496; 508/465; 508/363; 508/162

(58) Field of Classification Search ..... 508/465, 508/496, 363, 162

See application file for complete search history.

(56) References Cited

U.S. PATENT DOCUMENTS

| | | | | | |
|---|---|---|---|---|---|
| 1,980,097 | A | | 11/1934 | Ruddies | |
| 2,383,146 | A | | 8/1945 | Morgan | |
| 2,447,619 | A | | 8/1948 | Rogers et al. | |
| 2,594,286 | A | | 4/1952 | Bryant et al. | |
| 2,604,451 | A | | 7/1952 | Rocchini | |
| 3,843,531 | A | | 10/1974 | Nebzydoski et al. | |
| 3,894,958 | A | | 7/1975 | McCoy et al. | |
| 3,912,640 | A | * | 10/1975 | Anzenberger, Sr. | 508/254 |
| 4,010,007 | A | | 3/1977 | Bollinger et al. | |
| 4,062,788 | A | | 12/1977 | Schadenberg | |
| 4,154,958 | A | | 5/1979 | Bollinger et al. | |
| 4,456,454 | A | | 6/1984 | Jenkins, Jr. | |
| 4,496,368 | A | | 1/1985 | Kaufman et al. | |
| 4,517,105 | A | * | 5/1985 | Laemmle et al. | 508/496 |
| 4,602,919 | A | | 7/1986 | Jessup et al. | |
| 4,886,613 | A | | 12/1989 | Yoshimura et al. | |
| 4,886,614 | A | | 12/1989 | Yoshimura et al. | |
| 4,889,650 | A | | 12/1989 | Yoshimura et al. | |
| 5,259,978 | A | * | 11/1993 | Yoshimura et al. | 252/79 |
| 5,366,648 | A | * | 11/1994 | Salomon et al. | 508/251 |
| 5,439,614 | A | | 8/1995 | McConaghy, Jr. | |
| 5,464,569 | A | | 11/1995 | McConaghy, Jr. | |
| 6,096,692 | A | * | 8/2000 | Hagihara et al. | 508/307 |
| 6,797,680 | B2 | | 9/2004 | Chapaton et al. | |
| 2005/0176593 | A1 | * | 8/2005 | Ward et al. | 508/162 |
| 2006/0128574 | A1 | * | 6/2006 | Dong et al. | 508/557 |

FOREIGN PATENT DOCUMENTS

| | | |
|---|---|---|
| GB | 949290 | 2/1964 |

OTHER PUBLICATIONS

Abstract—Database WPI Week 199604 Thomson Scientific, London, GB; AN 1996-032670, XP002492213; JP07268369 Yachio Res YG) Oct. 17, 1995.

Abstract—Database WPI Week 198207 Thomson Scientific, London, GB; AN 1982-13153E, XP002492214; SU 825594B (Univ Rost) Apr. 30, 1981.

Abstract—Database WPI Week 197627 Thomson Scientific London, GB; AN 1976-51500X, XP002492215; SU 479802A (Electrogorsk Petr)) Dec. 2, 1975.

Search Report from corresponding PCT Publication No. WO 2008/070307 A3; date of publication of International search report; Nov. 27, 2008.

Written Opinion from corresponding PCT Application No. PCT/US2007/082057 dated Aug. 27, 2008.

ACS Abstract Document No. 138:26651—JP2002348586 (Citizen Watch Co., Ltd., Japan) Dec. 12, 2004.

ACS Abstract Document No. 136:373165—JP2002155944 (Matsushita Electric Industrial Co., Ltd.) May 31, 2002.

ACS Abstract Document No. 110:26495—SU1409643 (Dnepropetrovsk Chemical-Technological) Jul. 15, 1988.

ACS Abstract Document No. 100:9821—SU1046277 (Rostov State University, USSR) Oct. 7, 1983.

ACS Abstract Document No. 95:100360—SU825594 (Rostov State University, USSR) Apr. 30, 1981.

ACS Abstract Document No. 95:27661—SU810778 (Rostov State University, USSR) Mar. 7, 1981.

ACS Abstract Document No. 90:25715—RD174008 (Research Disclosure) Oct. 10, 1978.

ACS Abstract Document No. 71:72679—FR92118 (Brunel, Henri) Sep. 27, 1968.

* cited by examiner

*Primary Examiner* — Jim Goloboy
(74) *Attorney, Agent, or Firm* — David M. Shold; Christopher D. Hilker

(57) ABSTRACT

The present invention relates to a lubricating composition containing a dicarboxylic acid ester or a dicarboxylic acid amide as an antiwear agent. The invention further provides a lubricating composition suitable for the mechanical device such as an internal combustion engine.

12 Claims, No Drawings

ANTIWEAR AGENT AND LUBRICATING COMPOSITION THEREOF

FIELD OF INVENTION

The present invention relates to a lubricating composition containing a carboxylic acid or reactive equivalent thereof as an antiwear agent. The invention further provides a lubricating composition suitable for the mechanical device such as an internal combustion engine.

BACKGROUND OF THE INVENTION

It is well known for lubricating oils to contain a number of additives used to protect the mechanical devices such as internal combustion engines from wear, soot deposits and acidity build up. A common antiwear additive for engine lubricating oils is zinc dialkyldithiophosphate (ZDDP). It is believed that ZDDP antiwear additives protect the engine by forming a protective film on metal surfaces.

In recent years engine lubricants containing phosphorus compounds and sulphur have been shown to contribute in part to particulate emissions, and emissions of other pollutants. In addition, sulphur and phosphorus tend to poison the catalysts used in catalytic converters, resulting in a reduction in performance of said catalysts.

Other developments in engine oil lubricating oils have also reduced the amount of sulphur, phosphorus and sulphated ash. Thus this has typically lowered the amount of ZDDP used in the lubricating oils. However, even the reduced levels of phosphorus and sulphur from ZDDP may adversely poison the catalysts.

Consequently, it would be desirable to provide an alternative antiwear agent capable of at least one of (i) reducing or preventing phosphorus emissions, (ii) reducing or preventing sulphur emissions, and (iii) wholly or partially replacing ZDDP in lubricating oils. The present invention provides an antiwear agent capable of achieving at least one of (i) to (iii). In addition it may also be desirable for the antiwear agent to not have a detrimental affect on other components of a mechanical device e.g., a seal or provide lead and/or copper corrosion inhibition.

U.S. Pat. No. 2,604,451 discloses an adduct of an alpha hexyldecyl malonic acid (or alphacyclohexyl malonic acid) with dodecylamine. The resultant product is suitable for lubricant anticorrosion additives in e.g., internal combustion engines.

U.S. Pat. No. 4,062,788 discloses chlorophenyl malonic acid esters as suitable antiwear agents for engine oils. The chlorophenyl malonic acid esters may be used as alternatives to traditional ZDDP chemistry. The reference further discloses in an example a formulation using Qatar Marine base oil HVI60.

The use of malonic acid esters as a significant portion (20-30 wt %) of lubricating base oil is disclosed in SU 825594 and SU 810778. Specifically, SU discloses lubricating compositions with load-carrying, antiwear and antifriction performance containing malonic acid esters with C4-8 aliphatic groups. Whereas, SU 825594 discloses lubricating composition with antiwear performance containing di-C4-9-alkyl malonate.

Oxalates suitable for internal combustion engines are disclosed in U.S. Pat. No. 2,383,146 and U.S. Pat. No. 2,447,619. Specifically U.S. Pat. No. 2,383,146 discloses a lubricant containing dialkyl oxalates. Whereas U.S. Pat. No. 2,447,619 discloses sulphurised oleyl oxalates in crankcase lubricants.

SUMMARY OF THE INVENTION

In one embodiment the invention provides a lubricating composition comprising: an oil of lubricating viscosity and 0.01 wt % to less than 20 wt % of a malonic acid di-hydrocarbon ester having at least one carbon atom (more typically 4 to 30, or 6 to 20 carbon atoms) in each hydrocarbon group.

In one embodiment the invention provides a method for lubricating an engine oil comprising supplying to the engine a lubricating composition comprising: an oil of lubricating viscosity and 0.01 wt % to less than 20 wt % of a malonic acid di-hydrocarbon ester having at least one carbon atom (more typically 4 to 30, or 6 to 20 carbon atoms) in each hydrocarbon group.

In one embodiment the lubricating composition comprising 0.01 wt % to less than 20 wt % of the malonic acid di-hydrocarbon ester is further characterised as having at least one of (i) a sulphur content of 0.8 wt % or less, (ii) a phosphorus content of 0.2 wt % or less, or (iii) a sulphated ash content of 2 wt % or less.

In one embodiment the invention provides a lubricating composition comprising: an oil of lubricating viscosity and a compound of Formula (1):

Formula (1)

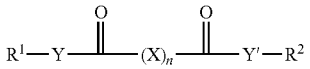

wherein n is 0 or 1 (when n=0, Formula (1) comprises an oxalic acid ester, amide, or half-ester half-amide, depending on Y and/or Y' groups; and when n=1, Formula (1) comprises a malonic acid ester, amide, or half-ester half-amide depending on the Y and/or Y' groups);

Y and Y' are independently —O—, >NH or >$NR^3$;

X comprises —$CH_2$—, >$CHR^4$ or >$CR^4R^5$;

$R^1$ and $R^2$ are independently hydrocarbyl groups, typically containing 4 to 30, or 6 to 20, or 10 to 20, or 11 to 18 carbon atoms;

$R^3$ is a hydrocarbyl group;

$R^4$ and $R^5$ are independently keto-groups, ester groups or hydrocarbyl groups; and wherein the lubricating composition is characterised as having at least one of (i) a sulphur content of 0.8 wt % or less, (ii) a phosphorus content of 0.2 wt % or less, or (iii) a sulphated ash content of 2 wt % or less.

In one embodiment the invention provides a method for lubricating an engine oil comprising supplying to the engine a lubricating composition comprising: an oil of lubricating viscosity and a compound of Formula (1):

Formula (1)

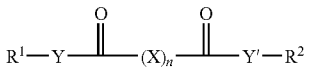

wherein n is 0 or 1;

Y and Y' are independently —O—, >NH or >$NR^3$;

X comprises —$CH_2$—, >$CHR^4$ or >$CR^4R^5$;

$R^1$ and $R^2$ are independently hydrocarbyl groups, typically containing 4 to 30, or 6 to 20, or 10 to 20, or 11 to 18 carbon atoms;

$R^3$ is a hydrocarbyl group;

$R^4$ and $R^5$ are independently keto-groups, ester groups or hydrocarbyl groups; and wherein the lubricating composition is characterised as having at least one of (i) a sulphur content of 0.8 wt % or less, (ii) a phosphorus content of 0.2 wt % or less, or (iii) a sulphated ash content of 2 wt % or less.

In one embodiment the lubricating composition comprising the compound of Formula (1) contains 0.01 wt % to less than 20 wt % of the compound of Formula (1).

In one embodiment the invention provides a lubricating composition comprising: an oil of lubricating viscosity and 0.01 wt % to less than 20 wt % of either (i) a malonic acid di-hydrocarbon ester having at least one carbon atom (more typically 4 to 30, or 6 to 20 carbon atoms) in each hydrocarbon group, or (ii) an oxalic acid di-hydrocarbon ester having at least one carbon atom, more typically 4 to 30, or 6 to 20 carbon atoms in each hydrocarbon group of the di-ester, wherein the lubricating composition is characterised as having at least one of (i) a sulphur content of 0.8 wt % or less, (ii) a phosphorus content of 0.2 wt % or less, or (iii) a sulphated ash content of 2 wt % or less.

In one embodiment the lubricating compositions disclosed herein further comprise a molybdenum compound. Examples of a suitable molybdenum compound include molybdenum dialkyldithiophosphates, molybdenum dithiocarbamates, amine salts of molybdenum compounds, or mixtures thereof.

In different embodiments the lubricating compositions disclosed herein contain 0 ppm to 500 ppm, or 5 ppm to 300 ppm, or 20 ppm to 250 ppm of molybdenum.

In one embodiment the invention provides a method for lubricating an engine oil comprising supplying to the engine a lubricating composition comprising: an oil of lubricating viscosity and 0.01 wt % to less than 20 wt % of either (i) a malonic acid di-hydrocarbon ester having at least one carbon atom (more typically 4 to 30, or 6 to 20 carbon atoms) in each hydrocarbon group, or (ii) an oxalic acid di-hydrocarbon ester having at least one carbon atom, more typically 4 to 30, or 6 to 20 carbon atoms in each hydrocarbon group of the di-ester, wherein the lubricating composition is characterised as having at least one of (i) a sulphur content of 0.8 wt % or less, (ii) a phosphorus content of 0.2 wt % or less, or (iii) a sulphated ash content of 2 wt % or less.

In one embodiment the invention provides for the use of the lubricating compositions disclosed above in an internal combustion engine as an antiwear agent.

DETAILED DESCRIPTION OF THE INVENTION

The present invention provides a lubricating composition and a method for lubricating an engine as disclosed above.

The malonic acid di-hydrocarbon ester and the compound of Formula (1) may be described as an antiwear agent. Typically the malonic acid di-hydrocarbon ester or compound of Formula (1) may be present at 0.01 wt % to less than 20 wt %, or 0.05 to 10 wt %, or 0.1 to 5 wt % of the lubricating composition.

Malonic Acid Di-Hydrocarbon Ester

In one embodiment each hydrocarbon group comprises an alkyl group. The alkyl group may be linear or branched. The number of carbon atoms in each hydrocarbon group may be the same or different. Typically each alkyl group independently contains 4 to 30, or 6 to 20, or 10 to 20, or 11 to 18 carbon atoms.

Examples of a suitable malonic acid di-hydrocarbon ester include di-2-ethylhexyl malonate, di-decyl malonate, di-undecyl malonate, di-dodecyl malonate, di-isotridecyl malonate, di-tridecyl malonate, di-butadecyl malonate, di-pentadecyl malonate, di-hexadecyl malonate, di-heptadecyl malonate, di-octadecyl malonate, or mixtures thereof.

In one embodiment each hydrocarbon group of the malonic acid di-hydrocarbon ester have a different number of carbon atoms. For example the malonic acid di-hydrocarbon ester may contain a mixture of hydrocarbon groups including $C_8$-$C_{10}$, $C_{10}$-$C_{12}$, $C_{12}$-$C_{14}$, $C_{12}$-$C_{15}$, or $C_{16}$-$C_{18}$.

In one embodiment each hydrocarbon group comprises an aryl group. Typically aryl groups contain 6 to 18, or 6 to 12 carbon atoms. Examples of suitable aryl groups include naphthyl or phenyl.

In one embodiment each hydrocarbon group comprises an alkaryl group. Typically the alkaryl groups contain 6 to 18, or 6 to 12 aryl carbon atoms; and 1 to 20 or 4 to 16 alkyl carbon atoms. Examples of a suitable alkaryl group include octyl phenyl or nonyl phenyl.

In one embodiment each hydrocarbon group comprises an cycloalkyl group. Examples of a suitable cycloalkyl group include a $C_{3-8}$-cycloalkyl, such as, cyclopropyl or cyclohexyl.

Compound of Formula (1)

When n=0, the compound of Formula (1) comprises an oxalate. When n=1, the compound of Formula (1) comprises a malonate.

In different embodiments $R^3$, $R^4$ and $R^5$ each independently contain 1 to 30, or 3 to 26, or 6 to 20, or 8 to 18 carbon atoms.

In one embodiment the total sum of the number of carbon atoms in all of the R groups (i.e. $\Sigma(R^1+R^2+R^3+R^4+R^5)$) may be 10 to 120, or 12 to 100, or 14 to 80.

In one embodiment X is —$CH_2$—, and $R^1$ and $R^2$ each contain 6 to 20, or 10 to 20, or 11 to 18 carbon atoms.

In one embodiment Y and Y' are oxygen.

In one embodiment the compound of Formula (1) is a half-ester half amide (Y is oxygen; and Y' is >NH or >$NR^3$).

In one embodiment the compound of Formula (1) is di-amide (Y and Y' are independently >NH or >$NR^3$

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content≦0.03 wt %, and ≧90 wt % saturates, viscosity index 80-120); Group III (sulphur content≦0.03 wt %, and ≧90 wt % saturates, viscosity index ≧120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the compound of Formula (1) or the malonic acid di-hydrocarbon ester and the other performance additives.

The lubricating composition may be in the form of a concentrate and/or a fully formulated lubricant. If the compound of Formula (1) or the malonic acid di-hydrocarbon ester are in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives comprise at least one of metal deactivators, viscosity modifiers, detergents, friction modifiers, antiwear agents (other than the compound of Formula (1) or the malonic acid di-hydrocarbon ester), corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition comprising the compound of Formula (1) or the malonic acid di-hydrocarbon ester further comprises at least one of a viscosity modifier, an antioxidant, an overbased detergent, a succinimide dispersant, or mixtures thereof.

In one embodiment the lubricating composition comprising the compound of Formula (1) or the malonic acid di-hydrocarbon ester further comprises a phosphorus-containing antiwear agent.

Detergents

The lubricant composition optionally further comprises other known neutral or overbased detergents. Suitable detergent substrates include phenates, sulphur containing phenates, sulphonates, salixarates, salicylates, carboxylic acid, phosphorus acid, mono- and/or di-thiophosphoric acid, alkyl phenol, sulphur coupled alkyl phenol compounds, or saligenins. Various overbased detergents and their methods of preparation are described in greater detail in numerous patent publications, including WO2004/096957 and references cited therein. The detergent substrate is typically salted with a metal such as calcium, magnesium, potassium, sodium, or mixtures thereof. In one embodiment the lubricating composition further includes an overbased detergent. Typically the overbased detergent includes phenates, sulphur containing phenates, sulphonates, salixarates, salicylates, or mixtures thereof.

The detergent may be present at 0 wt % to 10 wt %, or 0.1 wt % to 8 wt %, or 1 wt % to 4 wt %, or greater than 4 to 8 wt %.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, or 500 to 3000. Succinimide dispersants and their preparation are disclosed, for instance in U.S. Pat. No. 3,172,892 or U.S. Pat. No. 4,234,435. Succinimide dispersants are typically the imide formed from a polyamine, typically a poly(ethyleneamine).

In one embodiment the invention further comprises at least one dispersant derived from polyisobutylene with number average molecular weight in the range 350 to 5000, or 500 to 3000. The dispersant may be a polyisobutylene succinimide used alone or in combination with other dispersants.

In one embodiment the invention further comprises at least one dispersant derived from polyisobutylene succinic anhydride, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0 wt % to 20 wt %, or 0.1 wt % to 15 wt %, or 0.1 wt % to 10 wt %, or 1 wt % to 6 wt %, or 7 wt % to 12 wt % of the lubricating composition.

Antioxidants

Antioxidant compounds are known and include for example, sulphurised olefins, alkylated diphenylamines (typically di-nonyl diphenylamine, octyl diphenylamine, di-octyl diphenylamine), hindered phenols, molybdenum compounds (such as molybdenum dithiocarbamates), or mixtures thereof. Antioxidant compounds may be used alone or in combination. The antioxidant may be present in ranges 0 wt % to 20 wt %, or 0.1 wt % to 10 wt %, or 1 wt % to 5 wt %, of the lubricating composition.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 S-515, and S-600 from Asahi Denka Kogyo K. K and mixtures thereof.

Viscosity Modifiers

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl aryl conjugated diene copolymers, polyolefins, esters of maleic anhydride-styrene copolymers.

Dispersant Viscosity Modifiers

Dispersant viscosity modifiers (often referred to as DVM), include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine.

Antiwear Agents

The lubricant composition optionally further comprises at least one other antiwear agent other than the compound of Formula (1) or the malonic acid di-hydrocarbon ester. The antiwear agent may be present in ranges including 0 wt % to 15 wt %, or 0 wt % to 10 wt %, or 0.05 wt % to 5 wt %, or 0.1 wt % to 3 wt % of the lubricating composition. Examples of suitable antiwear agents include phosphate esters, sulphurised olefins, sulphur-containing anti-wear additives including metal dihydrocarbyldithiophosphates (such as zinc dialkyldithiophosphates or molybdenum dialkyldithiophosphates), thiocarbamate-containing compounds including, thiocarbamate esters, alkylene-coupled thiocarbamates, and bis(S-alkyldithiocarbamyl) disulphides.

Zinc dialkyldithiophosphats may generally be represented by the formula

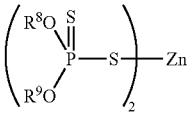

The $R^8$ and $R^9$ groups are independently hydrocarbyl groups that may be free from acetylenic and often also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethylhexanol and isopropanol or, alternatively, a mixture of secondary alcohols such as isopropanol and 4-methyl-2-pentanol. Such materials are well known and readily available to those skilled in the art of lubricant formulation.

In certain embodiments, examples of suitable zinc dialkyldithiophosphates include those disclosed in PCT Application US07/073,428 (entitled "Method of Lubricating an Internal Combustion Engine and Improving the Efficiency of the Emissions Control System of the Engine") or in PCT Application US07/073,426 (entitled "Lubricating Oil Composition and Method of Improving Efficiency of Emissions Control System"). Both applications claim priority from Jul. 17, 2006. The zinc dialkyldithiophosphates described therein may be defined as a zinc salt of a mixture of phosphorus-containing compounds represented by the Formula (2):

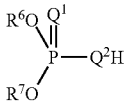

(2)

wherein in Formula (2), $Q^1$ and $Q^2$ are independently S or O, and $R^6$ and $R^7$ are independently hydrocarbyl groups, the average total number of carbon atoms in $R^6$ plus $R^7$ for the mixture of phosphorus-containing compounds being at least 9.5; wherein $R^6$ and $R^7$ are characterised in that (i) 4 to 70 weight percent of such groups contain 2 to 4 carbon atoms and (ii) 30 to 96 weight percent such groups contain 5 to 12 carbon atoms; and wherein, in less than 8 mole percent of the molecules of Formula (2) in the mixture of phosphorus-containing compounds, each of $R^6$ and $R^7$ contain 2 to 4 carbon atoms and in greater than 11 mole percent of the molecules of Formula (2) in said mixture $R^6$ has 2 to 4 carbon atoms and $R^7$ has 5 to 12 carbon atoms; and wherein, within Formula (2), the average total number of hydrogen atoms in $R^6$ and $R^7$ on carbon atoms located beta to the O atoms is at least 7.25.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octene, nonene, decene, undecene, dodecene, undecyl, tridecene, tetradecene, pentadecene, hexadecene, heptadecene, octadecene, octadecene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In an alternative embodiment, the ashless antiwear agent (which may also be described as a friction modifier) may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the ashless antiwear agent mixture include 5 to 95, or in other embodiments 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; sucrose; fructose; glucose; cyclohexanediol; erythritol; and pentaerythritols, including di- and tripentaerythritol. Often the polyol is diethylene glycol, triethylene glycol, glycerol, sorbitol, pentaerythritol or dipentaerythritol. The commercial material is believed to include about 60±5 percent by weight of the chemical species "glycerol monooleate," along with 35±5 percent glycerol dioleate, and less than about 5 percent trioleate and oleic acid. The amounts of the monoesters, described below, are the amounts of the commercial grade material.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

In one embodiment the further comprises a friction modifier, or mixtures thereof. Typically the friction modifier may be present in ranges including 0 wt % to 10 wt %, or 0.05 wt % to 8 wt %, or 0.1 wt % to 4 wt %.

Examples of suitable friction modifiers include long chain fatty acid derivatives of amines, fatty esters, fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid (all these friction modifiers have been described as antioxidants or antiwear agents).

In one embodiment the friction modifier is selected from the group consisting of long chain fatty acid derivatives of amines, esters, or epoxides; fatty alkyl tartrates; fatty alkyl tartrimides; and fatty alkyl tartramides.

In one embodiment the friction modifier is a long chain fatty acid ester (previously described above as an ashless antiwear agent). In another embodiment the long chain fatty acid ester is a mono-ester and in another embodiment the long chain fatty acid ester is a (tri)glyceride.

Other Additives

Other performance additives such as corrosion inhibitors include those described in paragraphs 5 to 8 of US Application US05/038319 (filed on Oct. 25, 2004 McAtee and Boyer as named inventors), octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Industrial Application

The lubricating composition may be utilised in a range of mechanical devices. The mechanical devices include an internal combustion engine, a gearbox, an automatic transmission, a hydraulic or a turbine. Typically the lubricating composition may be an engine oil, a gear oil, an automatic transmission oil, a hydraulic fluid, a turbine oil, a metal working fluid or a circulating oil.

In one embodiment the internal combustion engine may be a diesel fuelled engine, a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 325 ppm to 700 ppm. In one embodiment, the lubricant contains zinc dialkyldithiophosphate in an amount to provide 0.03 to 0.07 weight percent phosphorus. The total sulphated ash content may be 2 wt % or less, or 1.5 wt % or less, or 1.1 wt % or less, or 1 wt % or less, or 0.8 wt % or less, or 0.5 wt % or less. In one embodiment the sulphated ash content may be 0.05 wt % to 0.9 wt %, or 0.1 wt % to 0.2 wt % to 0.45 wt %.

In one embodiment the lubricating composition is an engine oil, wherein the lubricating composition is characterised as having (i) a sulphur content of 0.5 wt % or less, (ii) a phosphorus content of 0.1 wt % or less, and (iii) a sulphated ash content of 1.5 wt % or less.

In one embodiment the lubricating composition is suitable for a 2-stroke or a 4-stroke marine diesel internal combustion engine. In one embodiment the marine diesel combustion engine is a 2-stroke engine. The polymer of the invention may be added to a marine diesel lubricating composition at 0.01 to 20 wt %, or 0.05 to 10 wt %, or 0.1 to 5 wt %.

As used herein, the term "hydrocarbon" is used in its ordinary sense, which is well-known to those skilled in the art. Specifically, it refers to a group that only contains carbon and hydrogen.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The following examples provide illustrations of the invention. These examples are non-exhaustive and are not intended to limit the scope of the invention.

EXAMPLES

Preparative Example 1

A 4-neck vessel is charged with 104.06 g (1.0 mol) of malonic acid, 401.8 g (2.0 mol) of isotridecyl alcohol, 1.34 g of methane sulphonic acid (98%) and 200 g of toluene solvent. The vessel is equipped with a stirrer and purged with a nitrogen at a flow rate of 3.93 $cm^3/s$ (or about 0.5 scfh), thermocouple/thermocouple well, and Dean-Stark trap with water condenser. The vessel and its contents are heated to 120° C. and held for 10 hours whilst azeotropically removing water with toluene. The vessel is then heated to 130° C. for 8 hours whilst azeotropically removing water with toluene. Once the water is collected (35 g out of 36 g), the resulting solution is vacuum stripped at 120° C., at 0.7 kPa (or 5 torr) for 3 hours. The product is filtered with a filter aid and jarred. % Yield=99.6.

Preparative Example 2

A 4-neck vessel is charged with 99.08 g (0.75 mol) of dimethyl malonate, 300.6 g (1.5 mol) of $C_{12-14}$-alkyl alcohol (avg MW is 200.4 g/mol), and 1.04 g ($3.67\times10^{-3}$ mol) of titanium (IV) isopropoxide. The vessel is equipped with a stirrer and purged with a nitrogen at a flow rate of 3.93 $cm^3/s$ (or about 0.5 scfh), thermocouple/thermocouple well, and Dean-Stark trap with water condenser. The vessel and its contents are heated to 130° C. for 8 hours while draining trap methanol. The vessel is then heated to 130° C. for a further 4 hours. Once the methanol is collected (44 g out of 48 g), the resulting solution is stripped at 120° C. at 0.7 kPa (or 5 torr) for 3 hours. The product is filtered with a filter aid and jarred. % Yield=99.2.

Lubricating Compositions

Reference lubricating composition RLC1 is an engine oil containing conventional amounts of viscosity modifiers, antioxidants, overbased detergents, succinimide dispersants and antifoam agents. The composition further contains a phosphorus antiwear agent. The lubricating composition has a phosphorus content of 0.048 wt %, and a sulphur content of 0.19 wt %.

Reference lubricating composition RLC2 is an engine oil containing conventional amounts of viscosity modifiers, antioxidants, overbased detergents, succinimide dispersants and antifoam agents. The composition further contains a phosphorus antiwear agent. The lubricating oil is a mixture of Group II base oils. The lubricating composition has a phosphorus content of 0.03 wt %, and a sulphur content of 0.16 wt %.

Lubricating composition 1 (LC1) of the invention contains the same additives as RLC1, except 1 wt % of Preparative Example 1 is added.

Lubricating composition 2 (LC2) of the invention contains the same additives as RLC1, except 1 wt % of Preparative Example 2 is added.

Lubricating composition 3 (LC3) of the invention contains the same additives as RLC2, except 1 wt % of Preparative Example 1 is added.

Lubricating composition 4 (LC4) of the invention contains the same additives as RLC2, except 1 wt % of Preparative Example 2 is added.

Test 1: Cameron Plint Wear Test

The Cameron Plint TE-77™ is a reciprocating wear tester. In this test a steel ball upper specimen is reciprocated against a steel flat lower specimen. The Cameron Plint is charged with 10 ml of sample and heated to 50° C. and held for 1 minute. The sample is then subject to a load of 100 N over two minutes while at the same time the reciprocation is started at 10 Hz over 15 mm stroke length. The sample is then heated to 250° C. at 3° C. per minute. At the end of the test the average diameter of the wear scar (in micrometers) on the ball (measured in the X and Y directions) is measured using a calibrated microscope. The results obtained are shown in Table 1.

Test 2: Seals Test

The lubricating compositions are evaluated for compatibility with Viton® fluoroelastomer commercially available from DuPont by immersing a seal in the lubricating compositions for 96 hours at 150° C. The test evaluates percentage change in tensile strength, percentage change in elongation and the cracking tendency of the seal before and after immersion in the lubricating composition. Typically better results are obtained for samples that have lower percent changes in tensile strength and elongation. The results obtained are shown in Table 2.

Test 3: Corrosion

The lubricating compositions are evaluated for corrosion of copper and lead. Copper corrosion is determined by employing experimental techniques disclosed in ASTM D130-04e1 and ICP analysis of the lubricating compositions. The data obtained from ASTM D130 test include amount of copper on a visual rating (on scale 1A (no deposits) to 4C (heavy black deposits)). The ICP analysis determines the amount of lead and copper in the lubricating composition. The data obtained is presented in Table 3.

TABLE 1

| | Cameron Plint Data | | |
|---|---|---|---|
| Lubricating Composition | Wear Scar Diameter (μm) | Film Thickness (%) | Friction Coefficient |
| RLC1 | 661 | 62 | 0.117 |
| LC1 | 304 | 86 | 0.184 |
| LC2 | 309 | 86 | 0.145 |
| RLC2 | 924 | 27.1 | 0.159 |
| LC3 | 860 | 34.8 | 0.252 |
| LC4 | 982 | 17.8 | 0.220 |

TABLE 2

| | Seals Test Data | | |
|---|---|---|---|
| Lubricating Composition | Tensile Change % | Elongation Change % | Bend Test |
| RLC1 | — | — | Not cracked |
| LC1 | — | — | Not cracked |
| LC2 | — | — | Not cracked |
| RLC2 | −36.4 | −31.3 | Cracked |
| LC3 | −20.5 | −14.7 | Not cracked |
| LC4 | −15.9 | −9.8 | Not cracked |

Footnote to Table: percentage changes in tensile strength and Elongation for RLC1, LC1 and LC2 were not determined.

TABLE 3

| Lubricating Composition | Visual Rating | Copper content of oil (ppm) | Lead content of oil (ppm) |
|---|---|---|---|
| RLC2 | 4B | 109 | 7 |
| LC3 | 2A | 40 | 3 |
| LC4 | 2A | 41 | 3 |

Overall the results of Test 1 and Test 2 indicate that the lubricating composition of the invention containing a malonic acid di-hydrocarbon ester or a compound of Formula (1) is capable of imparting at least one of acceptable antiwear performance, lead and/or copper corrosion inhibition and seal compatibility.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for lubricating an internal combustion engine comprising supplying to the engine a lubricating composition comprising:

(a) an oil of lubricating viscosity;

(b) 0.1 wt % to 5 wt % of malonic acid di-hydrocarbon ester, wherein each hydrocarbon group independently is a $C_6$ to $C_{20}$ linear or branched alkyl group, and (c) a phosphorus-containing antiwear agent, wherein the internal combustion engine is a 2-stroke or 4-stroke engine.

2. The method of claim 1, wherein the oil of lubricating viscosity is an API Group I, Group II, or Group III oil, or mixtures thereof.

3. The method of claim 1, wherein the oil of lubricating viscosity is an API Group I, Group II, Group III, or Group IV oil, or mixtures thereof.

4. The method of claim 1, wherein the lubricating composition is further characterised as having at least one of (i) a sulphur content of 0.8 wt % or less, (ii) a phosphorus content of 0.2 wt % or less, or (iii) a sulphated ash content of 2 wt % or less.

5. The method of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

6. The method of claim 1, wherein the lubricating composition further comprises at least one of a friction modifier, a viscosity modifier, an antioxidant, an overbased detergent, a succinimide dispersant, or mixtures thereof.

7. The method of claim 6, wherein the friction modifier is selected from the group consisting of long chain fatty acid derivatives of amines, fatty esters, fatty epoxides; fatty imidazolines; amine salts of alkylphosphoric acids; fatty alkyl tartrates; fatty alkyl tartrimides; and fatty alkyl tartramides.

8. The method of claim 1, wherein the lubricating composition further comprises a molybdenum compound.

9. The method of claim 8, wherein the molybdenum compound is selected from the group consisting of molybdenum dialkyldithiophosphates, molybdenum dithiocarbamates, amine salts of molybdenum compounds, and mixtures thereof.

10. The method of claim 8, wherein the molybdenum compound provides 5 ppm to 300 ppm of molybdenum.

11. The method of claim 1, wherein the lubricating composition further comprises an overbased detergent.

12. The method of claim 11, wherein the overbased detergent is selected from the group consisting of phenates, sulphur containing phenates, sulphonates, salixarates, salicylates, and mixtures thereof.

* * * * *